US005127221A

United States Patent [19]

Beebe

[11] Patent Number: 5,127,221

[45] Date of Patent: Jul. 7, 1992

[54] TRANSPIRATION COOLED THROAT SECTION FOR LOW NOX COMBUSTOR AND RELATED PROCESS

[75] Inventor: Kenneth W. Beebe, Sartoga, N.Y.

[73] Assignee: General Electric Company, Schenectady, N.Y.

[21] Appl. No.: 520,267

[22] Filed: May 3, 1990

[51] Int. Cl.[5] ..... F23R 3/54; F02C 3/00

[52] U.S. Cl. ..... 60/39.02; 60/733; 60/754

[58] Field of Search ..... 60/754, 266, 265, 271, 60/732, 267, 39.02, 733

[56] References Cited

U.S. PATENT DOCUMENTS

| | | | |
|---|---|---|---|
| 3,557,553 | 1/1971 | Schmitz . | |
| 3,584,972 | 6/1971 | Bratkovich | 60/754 |
| 3,585,800 | 6/1971 | Kuntz | 60/265 |
| 3,623,711 | 11/1971 | Thorstenson | 263/19 A |
| 3,728,039 | 4/1973 | Plemmons et al. . | |
| 3,777,484 | 12/1973 | Dibelius et al. . | |
| 4,004,056 | 1/1977 | Carroll | 60/754 |
| 4,158,949 | 6/1979 | Reider . | |
| 4,180,972 | 1/1980 | Herman et al. . | |
| 4,195,475 | 4/1980 | Verdouw . | |
| 4,232,527 | 11/1980 | Reider | 60/754 |
| 4,269,032 | 5/1981 | Meginnis et al. | 60/754 |
| 4,292,801 | 10/1981 | Wilkes et al. | 60/733 |
| 4,302,940 | 12/1981 | Meginnis | 60/754 |
| 4,312,186 | 1/1982 | Reider | 60/754 |
| 4,420,929 | 12/1983 | Jorgensen et al. | 60/39.06 |
| 4,422,300 | 12/1983 | Dierberger et al. . | |
| 4,698,963 | 10/1987 | Taylor | 60/39.06 |

OTHER PUBLICATIONS

Carlstrom, L. A. et al., "Improved Emissions Performance in Today's Combustion System", Jun. 1978, pp. 1, 17 and 18.

*Primary Examiner*—Richard A. Bertsch
*Assistant Examiner*—Timothy S. Thorpe
*Attorney, Agent, or Firm*—Nixon & Vanderhye

[57] ABSTRACT

A method and apparatus are provided for reducing NOx emissions in dual stage, dual mode gas turbine combustors. The gas turbine combustor includes first and second combustion chambers separated by a reduced diameter throat section. The throat section is formed by converging and diverging wall sections constructed of porous material. A liner is provided in surrounding relationship to the throat region to form a plenum by which predetermined amounts of air are metered into the plenum and permitted to pass through the porous throat wall sections.

15 Claims, 1 Drawing Sheet

FIG. 1
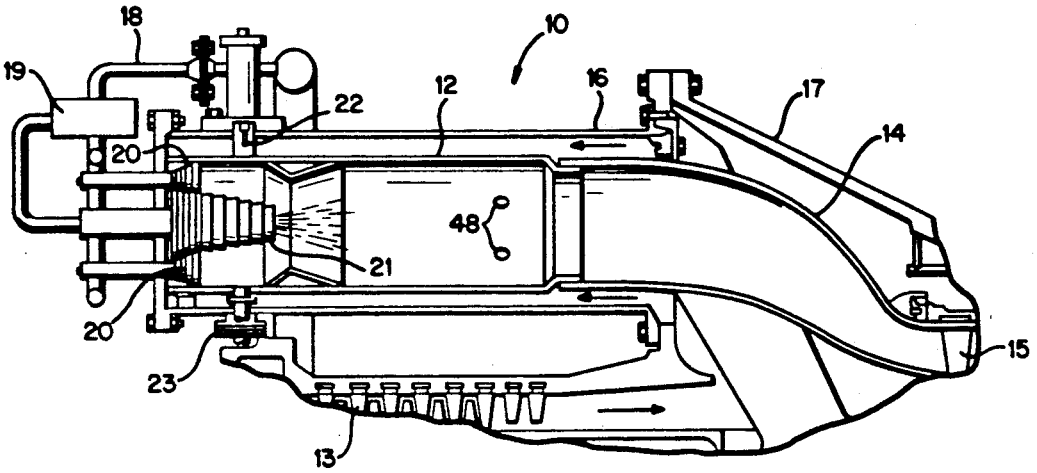
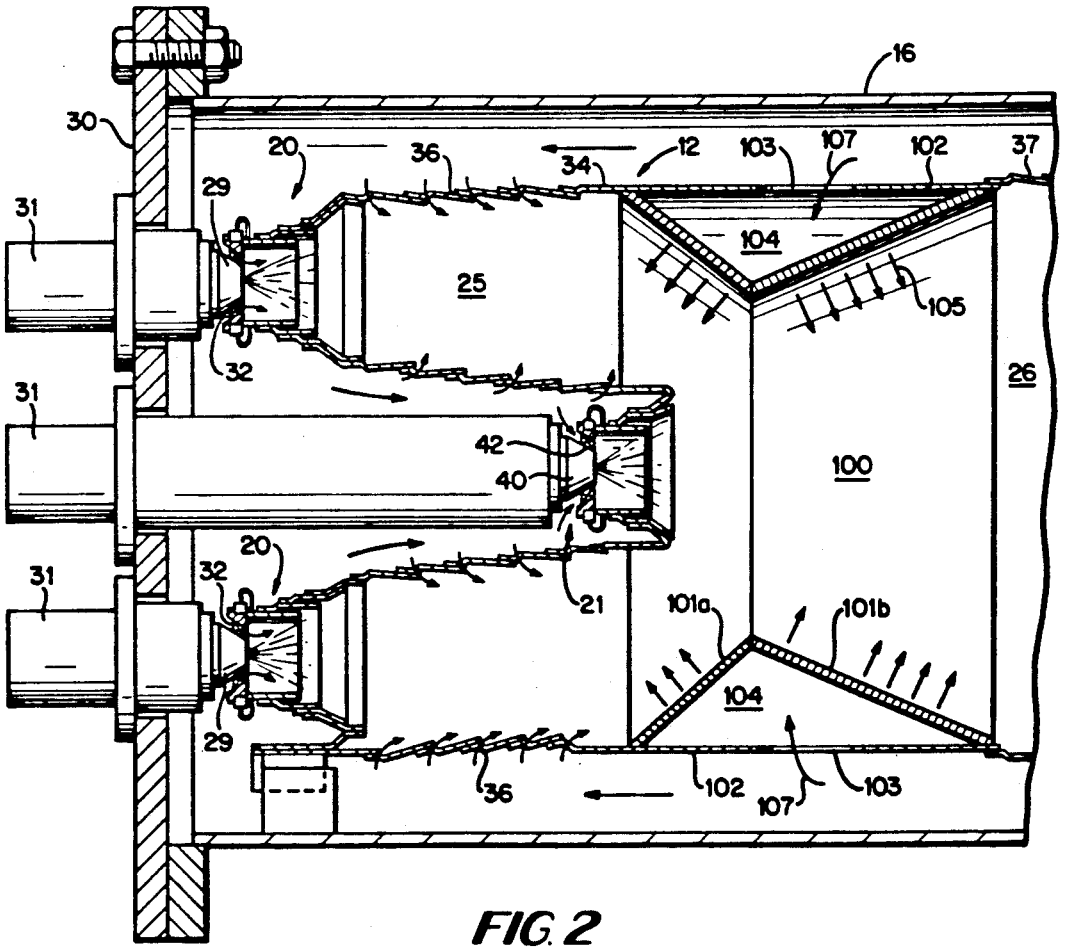
FIG. 2

TRANSPIRATION COOLED THROAT SECTION FOR LOW NOX COMBUSTOR AND RELATED PROCESS

RELATED APPLICATIONS

This invention relates to combustors for gas turbines, and more particularly to combustors capable of reduced NOx emissions.

BACKGROUND AND SUMMARY OF THE INVENTION

It is known that NOx formation increases with increasing flame temperature and with increasing residence time in the combustor. It is therefore theoretically possible to reduce NOx emissions from a combustor by reducing flame temperature and/or the time at which the reacting gases remain at peak temperatures. In practice, however, this is difficult to achieve because of the turbulent diffusion flame characteristics of present day gas turbine combustors. In such combustors, combustion takes place in a thin layer surrounding the evaporating liquid fuel droplets at a fuel/air equivalence ratio near unity, regardless of the overall reaction zone equivalence ratio. Since this is the condition which results in the highest flame temperature, relatively large amounts of NOx are produced. As a result, the conventional single stage, single fuel nozzle spray atomized combustors may not meet newly established emission standards regardless of how lean the nominal reaction zone equivalence ratio is maintained.

It is also known that significant reductions in NOx emissions can be achieved by injection of water or steam into the combustor reaction zone. However, such injection has many disadvantages including an increase in the system complexity and high water treatment costs.

The problem of realizing low NOx emissions develops further complexity where it is necessary to meet other combustion design criteria. Among such criteria are those of good ignition qualities, good cross firing capability, stability over the entire load range, large turn-down ratio, low traverse number, long life and ability to operate safely and reliably.

In commonly owned U.S. Pat. No. 4,292,801, there is described a dual stage-dual mode low NOx combustor for combustion turbine application. This combustor includes a throat section which separates the primary and secondary stages. Specifically, the combustor described in the above mentioned patent uses a throat section with film cooling air introduced via cooling slots formed by rolled ring sheet metal. This is a standard method of wall cooling used on current production combustors in gas turbine service. This method of cooling introduces a relatively large mass flow of cooling air at compressor discharge air temperature along the surface of the combustor throat section facing the combustion reaction zone. This method of cooling results in a relatively low temperature boundary layer with a very lean fuel/air mixture. It is known, however, that chemical reactions are quenched in this lean, low temperature boundary layer with the result that the emissions of carbon monoxide (CO) and unburned hydrocarbons (UHC) at the combustor exit are increased.

An alternative cooling scheme for the dual stage-dual mode low NOx combustor throat which has been applied is the use of vigorous backside convection cooling obtained by impinging cooling air jets. This method does not have the disadvantage of film air cooling which quenches chemical reactions. However, the backside cooling method is limited to clean natural gas fuel at current production gas turbine cycle conditions, because heat rejection from the throat section liner walls is not adequate for liquid fuels and advanced machine cycle conditions using only backside cooling methods. This limited heat rejection capability results in throat section liner wall temperatures which are too high for long term durability in gas turbine service when the dual stage-dual mode low NOx combustor is operated on liquid fuels and/or advanced machine cycle conditions.

The object of this invention is to provide a transpiration cooled throat section in a dual stage-dual mode low NOx combustor of the type described in U.S. Pat. No. 4,292,801 with sufficient durability for gas turbine service at current production cycle conditions using liquid fuels and at advanced machine cycle conditions using a variety of gaseous and liquid fuels. It is also an object of this invention to provide a method of cooling the throat section of the dual stage-dual mode low NOx combustor which does not quench chemical reaction in the combustor reaction zone, and which does not result in increased carbon monoxide and unburned hydrocarbon emissions at the combustor exit. It is further an object of this invention to prevent the formation of deposits on the surface of the throat section of the dual stage-dual mode low NOx combustor when operating on liquid fuel in the premixed mode.

In transpiration cooling, air or other fluid effuses through a porous structure into the boundary layer on the hot gas side in order to maintain the internal structure at a temperature below that of the hot gas stream. Thus, cooling is accomplished both by the absorption of heat within the wall by the coolant, as well as by the alteration of the boundary layer to thereby reduce the skin friction and heat transfer through the boundary layer.

Transpiration cooling in gas turbines is not new, reference being made to U.S. Pat. Nos. 3,557,553; 4,004,056; 4,158,949; 4,180,972; 4,195,475; 4,232,527; 4,269,032; 4,302,940; and 4,422,300.

Nevertheless, transpiration cooling has not heretofore been utilized in the throat region of a dual stage-dual mode combustor of the type utilized in this invention.

In an exemplary embodiment of the invention, the throat region is formed by converging and diverging wall sections, relative to the direction of fuel/air flow. The throat region thus presents a reduced diameter portion relative to the first and second combustion chambers.

In this exemplary embodiment, an outer liner surrounds the throat region to provide a cooling air plenum. A plurality of air metering holes are provided in the liner to provide the required cooling air (from the compressor) mass flow and pressure within the plenum.

The converging and diverging wall sections of the throat region are constructed of a porous metal material which permits transpiration cooling air injection into the throat region. It will be understood that the size and number of air metering holes and the porosity of the throat wall sections are chosen to provide that amount of transpiration cooling air necessary to match the local heat load which varies over the inner surfaces of the throat wall sections.

Accordingly, the present invention provides a method and apparatus for achieving a significant reduction in NOx emissions from a gas turbine without aggravating ignition, unburned hydrocarbon or carbon monoxide emission problems. More particularly, the dual stage-dual mode low NOx combustor of this invention includes first and second combustion chambers or stages interconnected by a throat region. Fuel and mixing air are introduced into the first combustion chamber for premixing. The first chamber includes a plurality of fuel nozzles positioned in circumferential orientation about the axis of the combustor and protruding into the first stage through the rear wall of the first chamber. Additional fuel is introduced near the downstream end of the first combustion chamber, and additional air is added in the throat region for combustion in the second combustion chamber.

The combustor is operated by first introducing fuel and air into the first chamber for burning therein. Thereafter, the flow of fuel is shifted into the second chamber until burning in the first chamber terminates, followed by a reshifting of fuel distribution into the first chamber for mixing purposes with burning occurring in the second chamber. The combustion in the second chamber is rapidly quenched by the introduction of substantial amounts of dilution air into the downstream end of the second chamber to reduce the residence time of the products of combustion at NOx producing temperatures, thereby providing a motive force for the turbine section which is characterized by low amounts of NOx, carbon monoxide and unburned hydrocarbon emissions.

At the same time, as the cooling air passes through the throat section walls, heat is transferred to the cooling air with the result that the cooling air is injected into the combustion reaction zone at temperatures close to the inside surface temperature of the throat section walls. Because less air is used in transpiration cooling vis-a-vis film air cooling, and because air enters the reaction zone at higher temperatures with transpiration cooling than with film air cooling, the cooling air in accordance with this invention will not result in quenching of chemical reactions in the boundary layer.

Moreover, in the premixed operating mode when using liquid fuels, droplets of liquid fuel will exist at the exit of the primary stage. These droplets can impinge on the inner surfaces of the throat section walls and result in the formation of deposits when the backside cooling technique is used. The present invention prevents the formation of such deposits because the transpiration cooling air removes any droplets on the inner surfaces of the throat wall sections.

In accordance with the broader aspects of one exemplary embodiment of the invention, therefore, there is provided a low NOx combustor for a gas turbine comprising first and second combustion chambers interconnected by a throat region, the throat region including converging and diverging wall sections constructed of porous metal material; and a cooling air plenum surrounding the throat region and including at least one air metering opening communicating the plenum with a cooling air source.

In accordance with another broad aspect of the invention, a method of cooling a reduced diameter throat region in a dual stage-dual mode gas turbine combustor is provided which includes the steps of:

a) providing a plenum surrounding the reduced diameter throat region;

b) supplying metered amounts of cooling air to said plenum;

c) providing porous metal wall sections to define the reduced diameter throat region; and d) introducing transpiration cooling air from the plenum through the porous metal wall sections to the throat region.

Other objects and advantages of the present invention will become apparent from the detailed description which follows.

BRIEF DESCRIPTION OF THE DRAWINGS

FIG. 1 is a partial cross-sectional view of a combustion turbine combustor in accordance with an exemplary embodiment of the invention; and FIG. 2 is a schematic cross-sectional view illustrating in greater detail the throat region interconnecting the first and second stages of the dual combustor shown in FIG. 1.

DETAILED DESCRIPTION OF THE DRAWINGS

FIG. 1 is a partial cross sectional view of a gas turbine dual stage—dual mode low NOx combustor 10 in accordance with U.S. Pat. No. 4,292,801, but modified in accordance with this invention as will be described further below.

The gas turbine 10 is typically of circular cross section having a plurality of combustors 12 which are spaced about the periphery of the gas turbine. The gas turbine also includes a compressor 13 which provides high pressure air for combustion and cooling. During operation of the turbine 10, combustor 12 burns fuel with high pressure air from the compressor 13, adding energy thereto, and a portion of the energy of the hot gases leaves the combustor 12 through a transition member 14 to the first stage nozzles 15 and turbine blades (not shown) mounted to the turbine wheel which drives the compressor 13 and a suitable load.

The low NOx combustor 12 is enclosed within a combustion casing 16 secured to the turbine casing 17. Fuel is brought to the turbine 10 via a fuel line 18 and fuel flow controller 19 which introduces the fuel into the combustor 12 through suitable fuel injection introduction means 20 and 21, such as fuel nozzles. The fuel introduction means 20 and 21 can be adapted to accept either gaseous or liquid fuels or by the use of a dual fuel nozzle, such as those described in U.S. Pat. Nos. 2,637,334 and 2,933,894, the combustor can be operated with either fuel. The fuel is ignited by well known ignition means, such as a spark plug 22, with ignition between adjacent combustors assured by the use of cross fire tubes 23.

FIG. 2 illustrates in greater detail the low NOx combustor 12 of the present invention, illustrating a first stage or chamber 25 and a second stage or chamber 26 in which the upstream end of the second chamber is interconnected with the downstream end of the first chamber by a throat region 100 of reduced cross section. The combustion chambers 25 and 26 are preferably circular in cross section, although other configurations can be employed as well. The chambers are preferably constructed of a high temperature metal which can withstand the firing temperatures typically encountered in a combustion turbine combustor. Cooling of the combustion chambers is preferably provided by air film cooling utilizing louvers such as described in U.S. Pat. No. 3,777,484 or slots as described in U.S. Pat. No.

3,728,039. However, other cooling arrangements such as water cooling, closed system cooling, steam film cooling and conventional air film cooling may be utilized as desired.

Fuel introduction means 20 are illustrated in FIG. 2 and comprise a plurality of fuel nozzles 29, for example six nozzles positioned in circumferential orientation about the axis of the combustor 12. The fuel nozzles 29 protrude into the first stage combustor 25 through the end cover 30. The fuel is conveyed to each fuel nozzle 29 through fuel lines 31 which extend beyond the end cover 30 and connect with the controller 19. Combustion air is introduced into the first stage through air swirlers 32 positioned adjacent the outlet end of the nozzles 29. The air swirlers 32 introduce swirling combustion air which mixes with the fuel from the fuel nozzles 29 and provides an ignitable mixture for combustion. Combustion air for the air swirlers 32 is derived from the compressor 13 and the routing of air between the combustion casing 16 and the wall 34 of the combustion chamber.

FIG. 2 also illustrates a plurality of spaced louvers 36 along the walls 34 of the first combustion chamber 25, and a plurality of louvers 37 along the walls of the second combustion chamber 26 for cooling purposes, as described above, and for introducing dilution air into the combustion zone to prevent substantial rises in flame temperatures.

Additionally, dilution holes 48 (illustrated in FIG. 1) provide for the rapid introduction of dilution air into the second combustion zone to further prevent substantial rises in flame temperature.

The first combustion chamber 25 also includes fuel introduction means 21 including a fuel nozzle 40, which may be similar to fuel nozzles 29 and which extends from the end cover 30 of the combustor toward the throat region 100 so that fuel may be introduced into the second combustion chamber 26 for burning therein. An air swirler 42 similar to air swirlers 32 is provided adjacent the fuel nozzle 40 for introducing combustor air into the fuel spray from the fuel nozzle 40 to provide an ignitable fuel-air mixture.

The throat region 100 is formed by a converging wall section 101*a* and a diverging wall section 101*b*. The throat region interconnects the first and second combustion chambers and functions as an aerodynamic separator or isolator for the prevention of flashback from the second chamber 26 to the first chamber 25. In order to perform this function, the throat region 100 is of reduced diameter relative to the combustion chambers. In general, it has been found that a ratio of the smaller of the first combustion chamber 25 or the second chamber 26 diameter to the throat region 100 diameter should be at least 1.2:1 and preferably about 1.5:1. However, larger ratios may be required or necessary to prevent flashback since a further factor affecting flashback is the location of the fuel introduction means 21 relative to the location at the throat region 100. More specifically, the closer the fuel introduction means 21 is to the throat region 100, the smaller the ratio of diameters may be without experiencing flashback. In view of the foregoing discussion, those skilled in the art can appreciate that the location of the fuel introduction means 21 relative to the throat region and the dimensions of the throat region relative to the combustion chambers can be optimized for minimum flashback by simple experimentation.

The throat region 100 is also contoured to provide a smooth transition between the chambers by the wall section 101*a* of uniformly decreasing diameter (converging) and the wall section 101*b* of uniformly increasing diameter (diverging).

The reduced diameter of the throat region 100, relative to combustion chambers 25 and 26, results in increased hot gas velocity in the throat region which in turn results in high convective heat transfer to throat section inner walls 101*a* and 101*b* from the hot gas. Because of the high convective heat transfer from the hot gas, vigorous cooling of the throat region is required to maintain the temperature of the inner walls 101*a* and 101*b* low enough for extended service life. The present invention provides the necessary cooling of the throat region by transpiration cooling as described below.

Cooling air 107 at compressor discharge air temperature enters a cooling air plenum chamber 104 formed by an outer liner 102 surrounding and extending between the walls 101*a* and 101*b* of the throat section via cooling air metering holes 103 provided in the liner. The cooling air metering holes 103 in the outer liner 102 are sized to provide the required cooling air mass flow and set the pressure in the cooling air plenum. The walls 101*a* and 101*b* of the throat section are porous, having a porosity characteristic which is predetermined to provide the required amount of transpiration cooling air injection (indicated by arrows 105) to match the local heat load which varies over the inner surfaces of the throat wall sections.

In this regard, the wall sections of the throat region are preferably constructed of a porous metal laminate material known by the trade name Lamilloy, produced by the Allison Gas Turbine Division of General Motors. A preferred base metal in the Lamilloy material is a Cobalt-Nickel alloy known as Hastelloy-X.

Transpiration cooling is known to be more efficient than film cooling which means that less cooling air will be injected per unit of surface area to maintain acceptable inner wall temperatures using the present invention than with film cooling. As the cooling air passes through the walls 101*a* and 101*b*, heat is transferred to the cooling air with the result that the cooling air is injected (as indicated by arrows 105) into the combustion reaction zone at temperatures close to the inner surface temperature of the walls 101*a* and 101*b*. Because less air is used with transpiration cooling than with film air cooling and the air enters the reaction zone at higher temperature with transpiration cooling than with film air cooling, the cooling air used in the present invention will not result in quenching of chemical reactions in the boundary layer which is known to occur with film air cooling.

In addition, in the premixed operating mode when using liquid fuels, droplets of liquid fuel will exist at the exit of the primary stage 25. These liquid fuel droplets can impinge on the surface of the inner walls 101*a* and 101*b* of the throat section and result in the formation of deposits when a backside cooling technique is used to cool the throat section. The present invention will prevent the formation of deposits because the transpiration cooling air injection 105 will remove the fuel droplets from the surface.

The present invention thus provides for throat section cooling in a dual-stage, dual-mode low NOx combustor wherein the throat section is sufficiently durable to withstand gas turbine service at current production cycle conditions using liquid fuels, and at advanced machine cycle conditions using a variety of gaseous and liquid fuels. The method and apparatus according to this invention also eliminates quenching of chemical reactions in the combustor reaction zone and thereby further reduces emissions at the combustor exit.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of cooling a throat region formed by converging and diverging wall sections in a dual stage, dual mode gas turbine combustor comprising the steps of:

a) forming said converging and diverging wall sections of a porous material and providing an outer liner in engagement with the converging and diverging wall sections to thereby form a plenum chamber surrounding said throat region;

b) supplying cooling air to said plenum chamber through a plurality of apertures; and c) introducing air from said plenum chamber through said porous wall sections as transpiration cooling air to said throat region.

2. The method of claim 1 wherein said porous wall sections comprise a Cobalt-Nickel alloy laminate.

3. A method of operating a gas turbine combustor to achieve reduced emissions of nitrogen oxide, said combustor including first and second combustion stages separated by a throat region of reduced diameter relative to said combustion stages, said throat region formed by converging and diverging wall sections formed of porous material; a plenum chamber surrounding said reduced diameter throat region, said chamber formed by an apertured combustor liner extending between said converging and diverging wall sections; a plurality of fuel nozzles and air swirlers for introducing fuel and air respectively into said first stage; and a single fuel nozzle and air swirler positioned adjacent said throat region for introducing additional fuel and air respectively into said second stage, the method comprising:

introducing fuel and air into said first stage from said plurality of fuel nozzles and air swirlers for mixing therein to create a combustible fuel-air mixture;

introducing additional fuel and air into said second stage from said single fuel nozzle and air swirler, said additional fuel and air mixing with the combustible fuel-air mixture in said second stage for combustion therein; and introducing air into said throat region from said plenum chamber.

4. The method of claim 3 and including the further step of:

introducing dilution air into the downstream end of said second stage to reduce residence time of the products of combustion at NOx producing temperatures in said second stage.

5. The method of claim 3 wherein aid first and second stages include walls having a plurality of openings therein and introducing compressed air into said first and second stages through said plurality of openings.

6. The method of claim 3 wherein said porous material comprises a Cobalt-Nickel alloy laminate.

7. The method of claim 3 wherein said porous wall sections have a porosity chosen as a function of an amount of cooling air required to match local heat loading which varies over inner surfaces of said wall sections.

8. A low NOx combustor for a gas turbine comprising:

first and second combustion chambers interconnected by a throat region including converging and diverging wall sections constructed of porous material; and a cooling air plenum chamber surrounding said throat region and formed by an apertured liner wall extending between said converging and diverging wall sections, said liner wall having at least one air metering opening communicating said plenum with a cooling air source.

9. The combustor according to claim 8 and further comprising:

first fuel introduction means adjacent an upstream end of said first chamber for introducing fuel therein, said first fuel introduction means comprising a plurality of fuel nozzles circumferentially positioned along a wall of said first combustion chamber and projecting into said first chamber;

first means adjacent said plurality of fuel nozzles of said first fuel introduction means for introducing compressed air into aid first chamber for mixing with said fuel and creating a combustible fuel-air mixture therein;

second fuel introduction means for introducing fuel into said second chamber for mixing with the fuel-air mixture or combustion products from said first chamber for burning in said second chamber;

second means adjacent said second fuel introduction means for introducing compressed air into said second combustion chamber for mixing with said fuel; and means for introducing dilution air into the downstream end of said second combustion chamber.

10. The combustor of claim 8 wherein aid converging and diverging wall sections of said throat region have a porosity which is selected to provide amount of transpiration cooling air in said throat region sufficient to match local heat loading which varies over interior surfaces of said wall sections.

11. A low NOx combustor for a gas turbine comprising:

first and second combustion chambers interconnected by a throat region;

first fuel introduction means adjacent the upstream end of said first chamber for introducing fuel into said first chamber;

first air introduction means for introducing compressed air into said first chamber for mixing with said fuel to create a combustible fuel/air mixture therein;

second fuel introduction means for introducing fuel into said second chamber for burning in said second chamber; said second fuel introudction means positioned in said throat region;

second air introduction means adjacent said second fuel introduction means for introducing compressed air into said second combustion chamber; and means for introducing transpiration cooling air into said throat region, said means including a plenum chamber surrounding said throat region, said plenum chamber formed by converging and diverging porous wall sections and a combustor liner wall having openings therein connecting remote ends of said converging and diverging wall sections.

12. The combustor according to claim 17 wherein said wall sections have a porosity chosen to provide a predetermined amount of said transpiration cooling air to said throat region to substantially match local heat loading which varies over inner surfaces of said throat region.

13. The combustor according to claim 12 wherein a plurality of air metering holes are provided to supply cooling air to said plenum, said holes being sized to provide a predetermined cooling air mass flow and pressure in said plenum.

14. The combustor according to claim 11 wherein a plurality of air metering holes are provided to supply cooling air to said plenum, said holes being sized to provide a predetermined cooling air mass flow and pressure in said plenum.

15. The combustor according to claim 11 wherein said porous wall sections comprise a Cobalt-Nickel alloy laminate.

* * * * *